US009067114B2

(12) United States Patent
Deming et al.

(10) Patent No.: US 9,067,114 B2
(45) Date of Patent: Jun. 30, 2015

(54) FLYING DISC TARGET AND METHOD OF USING THE SAME

(71) Applicant: JJC Outdoors, LLC, Agawam, MA (US)

(72) Inventors: James Richard Deming, Agawam, MA (US); Jeffrey Paul Faust, Somers, CT (US)

(73) Assignee: JJC Outdoors, LLC, Agawam, MA (US)

( * ) Notice: Subject to any disclaimer, the term of this patent is extended or adjusted under 35 U.S.C. 154(b) by 86 days.

(21) Appl. No.: 13/733,306

(22) Filed: Jan. 3, 2013

(65) Prior Publication Data

US 2014/0183823 A1 Jul. 3, 2014

(51) Int. Cl.

| | |
|---|---|
| ***A63B 63/00*** | (2006.01) |
| ***A63B 67/06*** | (2006.01) |
| ***A63B 71/06*** | (2006.01) |
| ***F41J 3/00*** | (2006.01) |
| ***F41J 5/02*** | (2006.01) |
| ***F41J 5/04*** | (2006.01) |
| ***F41J 5/06*** | (2006.01) |

(52) U.S. Cl.

CPC ..... *A63B 67/06* (2013.01); *A63B 71/0622* (2013.01); *A63B 71/0669* (2013.01); *A63B 2071/0694* (2013.01); *A63B 2209/10* (2013.01); *A63B 2210/50* (2013.01); *A63B 2220/80* (2013.01); *A63B 2220/803* (2013.01); *A63B 2220/805* (2013.01); *A63B 2220/833* (2013.01); *A63B 2225/09* (2013.01); *A63B 2225/093* (2013.01); *A63B 2225/50* (2013.01); *A63B 2225/54* (2013.01); *F41J 3/00* (2013.01); *F41J 5/02* (2013.01); *F41J 5/04* (2013.01); *F41J 5/06* (2013.01)

(58) Field of Classification Search

CPC .... A63B 63/00; A63B 63/003; A63B 63/004; A63B 67/06; A63B 2210/50; A63B 2210/54; A63B 2024/004; F41J 1/10; F41J 3/0004; F41J 3/0019; A63F 9/0204

USPC ..... 273/398–402, 407, 371; 473/476–478, 473/197, 454–456

See application file for complete search history.

(56) References Cited

U.S. PATENT DOCUMENTS

| | | | | | |
|---|---|---|---|---|---|
| 215,033 | A | * | 5/1879 | Wright et al. | 273/407 |
| 429,942 | A | * | 6/1890 | McBride | 273/407 |
| 507,098 | A | * | 10/1893 | Bates | 273/401 |
| 1,279,654 | A | * | 9/1918 | Charlesworth | 273/399 |
| 2,247,852 | A | * | 7/1941 | Saunders | 273/412 |
| 3,580,578 | A | * | 5/1971 | McCarthy | 473/471 |
| 3,856,298 | A | * | 12/1974 | Frantti | 473/446 |
| 4,461,485 | A | * | 7/1984 | Horvath et al. | 473/589 |
| 4,625,974 | A | * | 12/1986 | Andrews | 273/407 |
| 4,635,943 | A | * | 1/1987 | Lumpkin | 273/402 |
| 5,145,133 | A | * | 9/1992 | France | 248/168 |
| 5,503,356 | A | * | 4/1996 | Shelby | 248/170 |
| 5,536,017 | A | * | 7/1996 | Salisian | 273/375 |

(Continued)

*Primary Examiner* — Mark Graham

(74) *Attorney, Agent, or Firm* — Pitts & Lake, P.C.

(57) ABSTRACT

A flying disc target which includes a frame having a plurality of adjustable legs and a support member having a plurality of hinges, each leg coupled to a hinge of the support member and a target member detachably coupled to the frame, the target member having a first surface and an opposing second surface, the target member includes at least one pocket extending from the first surface toward the second surface, wherein the pocket is configured to receive and store a flying disc.

4 Claims, 12 Drawing Sheets

(56) References Cited

U.S. PATENT DOCUMENTS

| | | | | |
|---|---|---|---|---|
| 5,941,529 | A * | 8/1999 | Kinsey | 273/401 |
| 6,779,797 | B1 * | 8/2004 | Chou | 273/391 |
| 7,401,785 | B1 * | 7/2008 | Waite | 273/400 |
| 7,621,536 | B2 * | 11/2009 | Orzech et al. | 273/400 |
| 8,091,895 | B2 * | 1/2012 | Allen | 273/407 |
| 8,413,990 | B2 * | 4/2013 | Allshouse et al. | 273/371 |
| 8,720,896 | B2 * | 5/2014 | Matthis | 273/407 |
| 8,827,845 | B1 * | 9/2014 | Griffin | 473/446 |
| 2003/0030218 | A1 * | 2/2003 | Zucchi et al. | 273/371 |
| 2004/0214665 | A1 * | 10/2004 | Kane et al. | 473/433 |
| 2005/0134001 | A1 * | 6/2005 | Rowan | 273/401 |
| 2008/0111312 | A1 * | 5/2008 | Longo et al. | 273/402 |
| 2010/0062880 | A1 * | 3/2010 | Hayes | 473/422 |
| 2010/0090407 | A1 * | 4/2010 | Lin | 273/371 |
| 2010/0140873 | A1 * | 6/2010 | Britton et al. | 273/398 |
| 2011/0042901 | A1 * | 2/2011 | Raymond | 273/407 |
| 2011/0074111 | A1 * | 3/2011 | Jackson | 273/400 |
| 2014/0145401 | A1 * | 5/2014 | Powers et al. | 273/402 |

* cited by examiner

FIG. 6
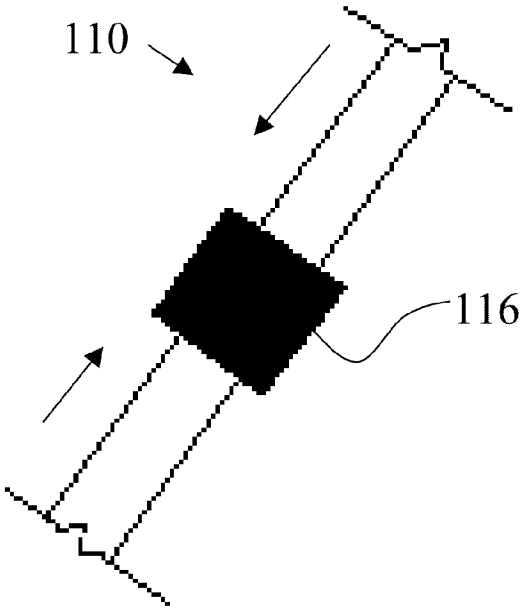
FIG. 6B
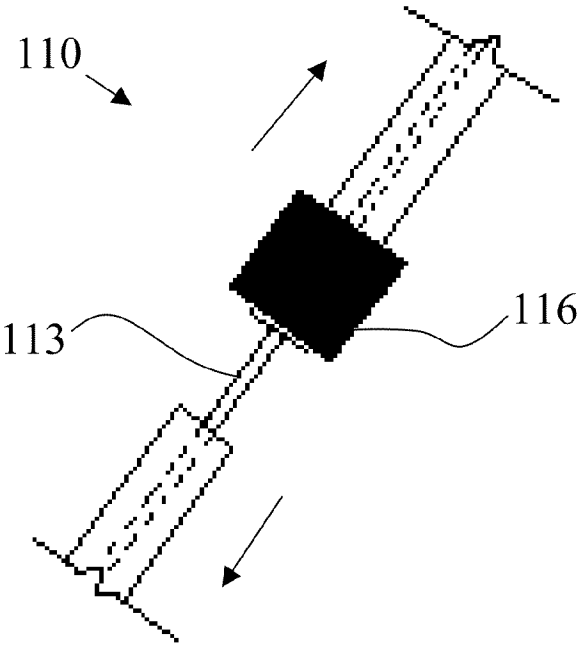
FIG. 6A

FLYING DISC TARGET AND METHOD OF USING THE SAME

CROSS-REFERENCE TO RELATED APPLICATIONS

This application claims the benefit of U.S. Provisional Patent Application No. 61/692,489, filed on Aug. 23, 2012.

BACKGROUND

1. Field of the Invention

The present general inventive concept relates to a flying disc target and a method of using the same. More particularly, the present general inventive concept relates to a collapsible flying disc target having an interchangeable target pattern.

2. Description of the Related Art

Over the past several years, flying saucers and games using flying saucers have been increasingly popular with people of all ages. Typical games involve testing players skill and accuracy in throwing the flying saucers at particular targets.

Conventional flying saucer targets include a frame which stands upright from the ground and which includes at least one opening through which users throw the saucers through. However, the conventional flying saucer targets such as the one disclosed by U.S. Pat. No. 4,373,734 are complicated to setup, difficult to store, and only provide targets for users of one skill level. The saucer target frame in the disclosed patent requires a user to assemble multiple resilient rods together and then attach a cover onto the rods.

The users of these conventional saucer targets often become accustomed to the size, position, and location of the targets and therefore will easily become proficient and will discontinue use soon thereafter.

In addition, these saucer targets require a considerable amount of time and effort to setup prior to being used. Also, since the height of these types of targets is fixed, they cannot be adjusted to accommodate users of different heights and/or skill levels. Furthermore, the frames on which these typical targets are supported are bulky, instable and may be easily blown over by a gust of wind.

It is therefore highly desirable to provide an improved saucer target, which is collapsible yet stable, as well as being adjustable in height to accommodate users of various heights and skill levels. In addition, it is also desirable to provide an improved saucer target which includes interchangeable targets which can be replaced to accommodate users of different skill levels.

BRIEF SUMMARY OF THE INVENTION

The present general inventive concept provides a flying disc target having a collapsible tripod base.

The present general inventive concept also provides a flying disc target made of a flexible and durable material.

The present general inventive concept also provides for interchangeable a flying disc targets affixed to the collapsible tripod base.

The present general inventive concept also provides a method of using the flying disc target.

Additional aspects and utilities of the present general inventive concept will be set forth in part in the description which follows and, in part, will be obvious from the description, or may be learned by practice of the general inventive concept.

Certain of the foregoing and related aspects are readily attained according to the present general inventive concept by providing a flying disc target which includes a frame having a plurality of adjustable legs and a support member having a plurality of hinges, each leg coupled to a hinge of the support member and a target member detachably coupled to the frame, the target member having a first surface and an opposing second surface, the target member includes at least one pocket extending from the first surface toward the second surface, wherein the pocket is configured to receive and store a flying disc.

The length of each leg may be expandable from a first length to a different second length.

The angle between each leg and the support member may be adjustable.

The target member may be formed of a flexible material which is formed into loops using an attachment means.

The pocket may be configured to be substantially horizontal.

The pocket may include an electronic sensor to detect a flying disc.

The electronic sensor may include a light sensor, a motion sensor, or an RFID sensor.

The flying disc target may further include a plurality of pockets having varying heights and widths, wherein the electronic sensor activates a particular LED corresponding to a particular pocket when a flying disc is detected.

Each pocket of the plurality of pockets may include an associated score based on the height and width of the pocket.

The electronic sensor may transmit a signal indicating the score corresponding to the particular pocket in which the flying disc is detected to a mobile device, the mobile device having an application to display and record a total score.

Certain of the foregoing and related aspects are readily attained according to the present general inventive concept by also providing a flying disc target which includes a collapsible tripod frame, the frame including a plurality of expandable legs coupled to a triangular shaped top hinge, and a flexible target member detachably coupled to a first and second expandable leg of the plurality of expandable legs, the flexible target member having a front face and an opposing back face, the flexible target including a plurality of disc storage compartments having openings formed through the front face of the flexible target member, the plurality of disc storage compartments extending from the front face toward the back face, wherein the plurality of disc storage compartments having varying heights and widths.

A length of each leg may be expandable from a first length to different second length, the second length being larger than the first length.

An angle between each leg and the support member may be adjustable to form a tripod shape.

Each disc storage compartment of the plurality of disc storage compartments may include an associated score based on a height and a width of the disc storage compartment.

The flying disc target may further include an electronic sensor which detects a disc entering each of the plurality of disc storage compartments and transmits a signal representing the score earned corresponding to the particular disc storage compartment in which the flying disc is detected to an external device.

The external device may include a mobile device having an application to display and record a total score for multiple users.

BRIEF DESCRIPTION OF THE DRAWINGS

The general inventive concept is further described in the detailed description that follows, by reference to the noted drawings by way of non-limiting illustrative exemplary embodiments of the general inventive concept, in which like reference numerals represent similar parts throughout the drawings. As should be understood, however, the general inventive concept is not limited to the precise arrangements and instrumentalities illustrated.

An exemplary embodiment of the present general inventive concept, which in no way limits the claims will now be more particularly described by way of example with reference to the accompanying drawings, wherein:

FIG. 6A is a top perspective view of an adjustable leg, in an expanded state, according to an exemplary embodiment of the present general inventive concept;

FIG. 6B is a top perspective view of the adjustable leg in FIG. 6A, in a collapsed state;

DETAILED DESCRIPTION OF THE PREFERRED EMBODIMENTS

Figure 1:
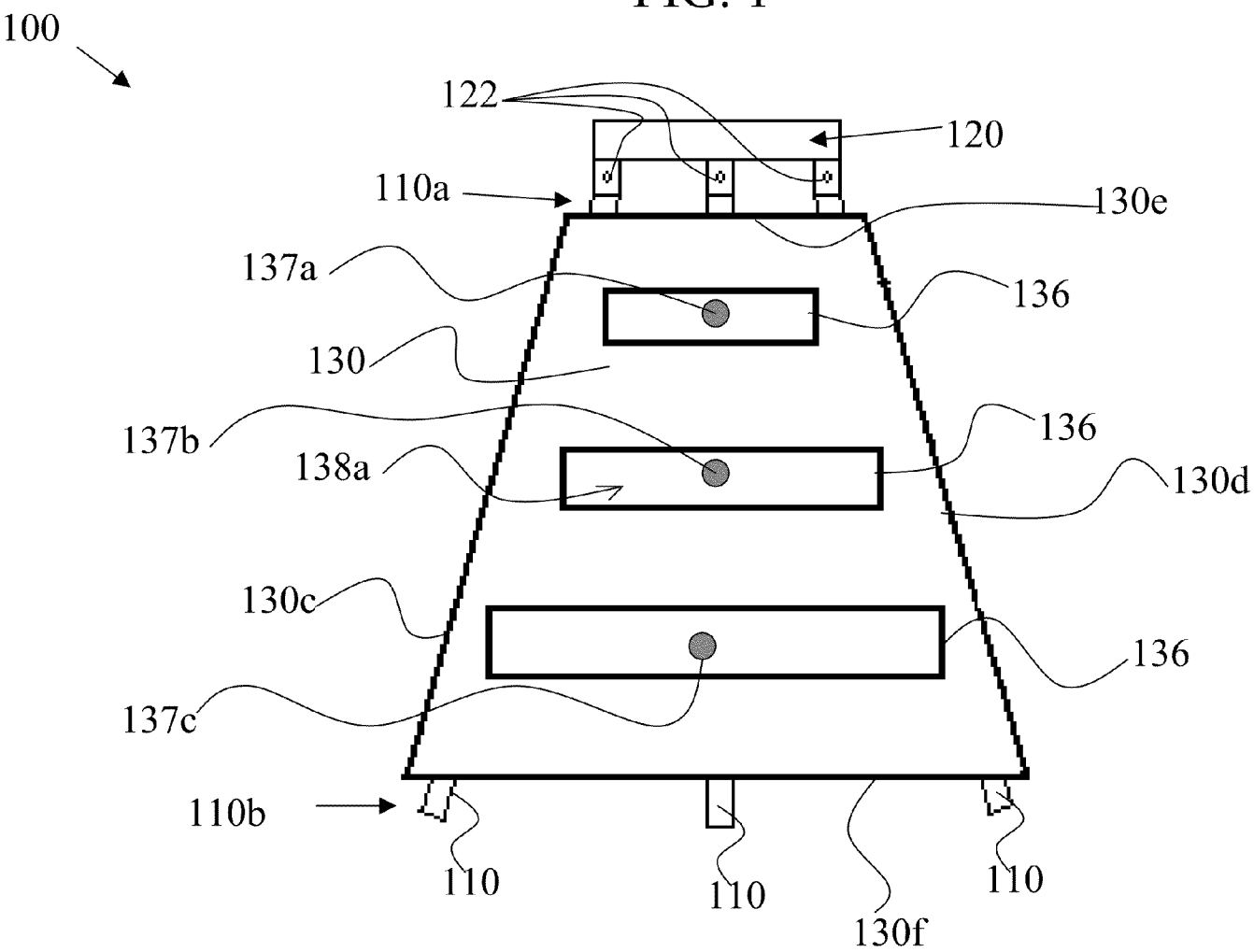
FIG. 1 is a front view of the flying disc target according to an exemplary embodiment of the present general inventive concept.

The general inventive concept now will be described more fully hereinafter with reference to the accompanying drawings, in which exemplary embodiments of the present general inventive concept are shown. This general inventive concept may, however, be embodied in many different forms and should not be construed as limited to the embodiments set forth herein. Rather, these embodiments are provided so that this disclosure will be thorough and complete, and will fully convey the scope of the present general inventive concept to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present general inventive concept.

The terminology used herein is for the purpose of describing particular embodiments only and is not intended to be limiting of the general inventive concept. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present general inventive concept are described herein with reference to cross section illustrations which are schematic illustrations of idealized embodiments of the present general inventive concept. As such, variations from the shapes of the illustrations as a result, for example, of manufacturing techniques and/or tolerances, are to be expected. Thus, embodiments of the present general inventive concept should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present general inventive concept.

The present general inventive concept relates to a flying disc target and a method of using the same. More particularly, the present general inventive concept relates to a flying disc target that is supported with a collapsible tripod frame.

Figure 2:
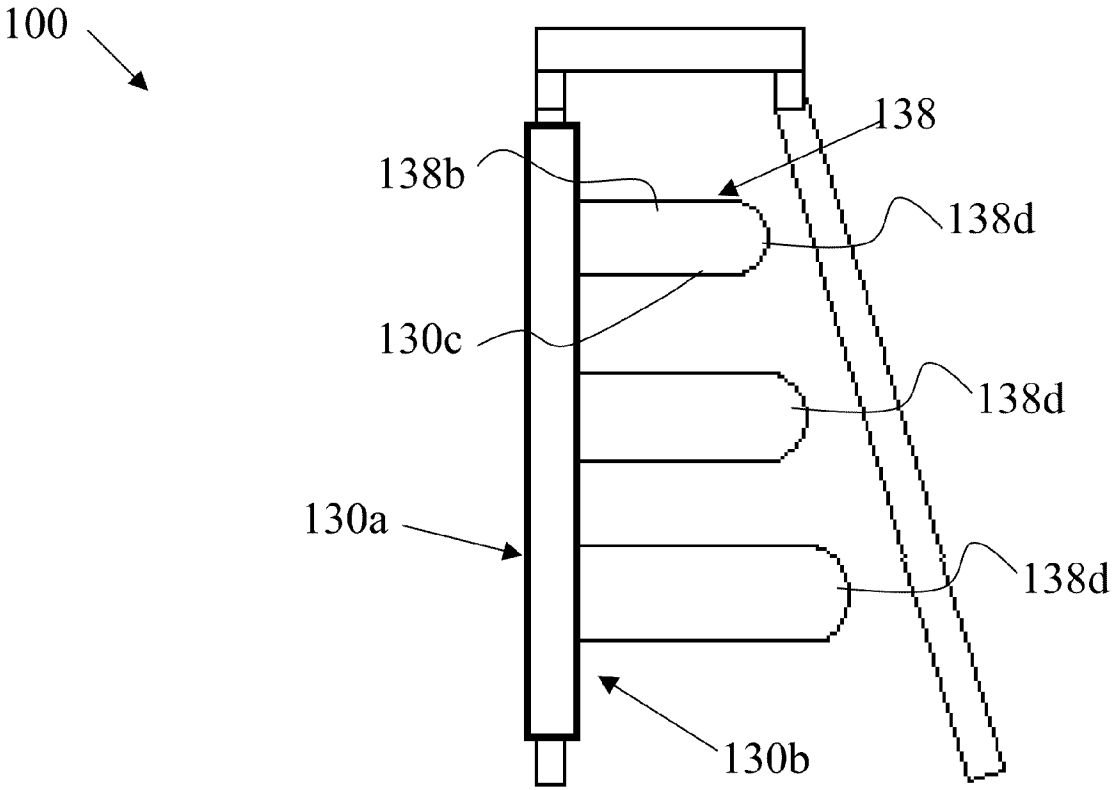
FIG. 2 is a side view of the flying disc target illustrated in FIG. 1.
Figure 3:
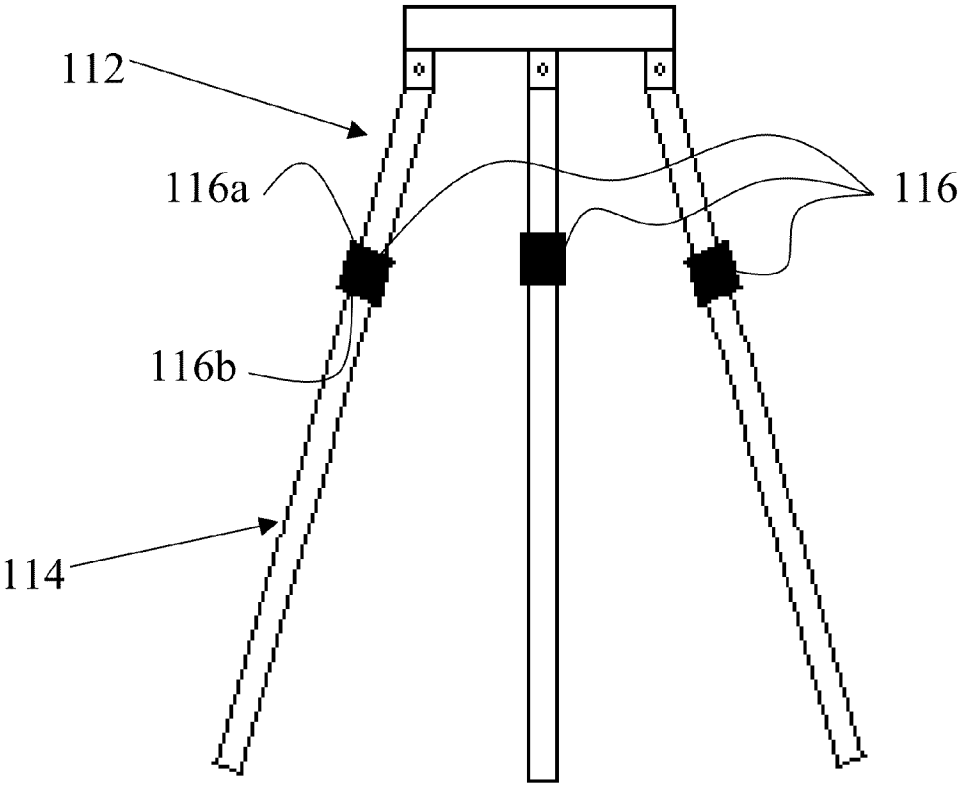
FIG. 3 is a front view of the flying disc target illustrated in FIG. 1, with the flexible target removed, according to an exemplary embodiment of the present general inventive concept.

FIG. 1 is a front view of the flying disc target 100 according to an exemplary embodiment of the present general inventive concept and FIG. 2 is a side view of the flying disc target 100 illustrated in FIG. 1. FIG. 3 is a front view of the flying disc target 100 illustrated in FIG. 1, with the flexible target 130 removed, according to an exemplary embodiment of the present general inventive concept.

Referring to FIGS. 1-3, according to an exemplary embodiment, the flying disc target 100 includes a plurality of adjustable legs 110 coupled to a top hinge 120, and a flexible target 130 detachably attached to the adjustable legs 110. The top hinge 120 is designed to allow the adjustable legs 110 to fold to form a tripod shaped base. (See FIG. 3)

In alternative exemplary embodiments, the flying disc target 100 may include four or more adjustable legs 110 attached to the top hinge 120, so as to form various shapes to create a stable base for the flying disc target 100. In particular, the top hinge 120 includes a plurality of hinge members 122 which are coupled to a first end 110*a* (i.e., a top end) of each of the adjustable legs 110. The hinge members 122 allow a second end 110*b* (i.e., a bottom end) of the adjustable legs 110 to collapse toward each other so that the flying disc target 100 may be easily stored.

In alternative exemplary embodiments, the second end 110*b* of the adjustable legs 110 may be fitted with interchangeable feet which includes a rubber portion or a sharpened point to provide traction on a variety of surfaces. However, the present general inventive concept is not limited thereto.

The plurality of hinge members 122 are attached to a top hinge base 124. In exemplary embodiments, the top hinge base 124 may be formed in various shapes and sizes to allow for the adjustable legs 110 to be adjusted in various orientations. The hinge members 122 may further include an opening 122*a* having a width 123 corresponding to a width 113 of the adjustable legs 110. The hinge members 122 may further include a fastening member 125 which pivotally couples the adjustable legs 110 to the hinge members 122. The fastening member 125 may include a screw, a rivet, a bolt, or various other types of conventional fastening devices. However, the present general inventive concept is not limited thereto.

In the present exemplary embodiment, the opening 122*a* includes a first sidewall 123*a* and an opposing second sidewall 123*b*. That is, when the adjustable legs 110 are assembled into the hinge members 122 and pivotally attached with a fastening member 125, the first and second sidewalls 123*a*, 123*b* are parallel to a plane in which the adjustable legs 110 is allowed to rotate.

In alternative exemplary embodiments, the plurality of hinge members 122 may rotate with respect to the top hinge base 124 so as to control a plane in which the adjustable legs 110 are allowed to rotate.

Referring to FIG. 3, each adjustable leg 110 comprises a plurality of segments including a first segment 112 and a second segment 114 which are coupled together with a locking member 116. The locking member 116 may be rotated in a first direction (i.e., a clockwise direction) to allow the second segment 114 to expand with respect to the first segment 112. Conversely, the locking member 116 may be rotated in a second direction (i.e., a counter-clockwise direction) to lock the first segment 112 to the second segment 114.

Figure 4:
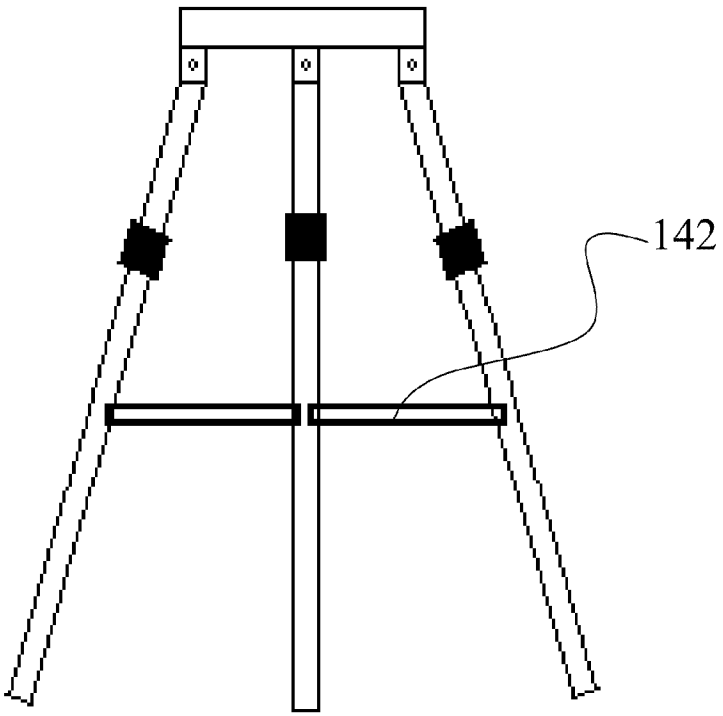
FIG. 4 is a front view of the flying disc according to another exemplary embodiment, with the flexible target removed.
Figure 5:
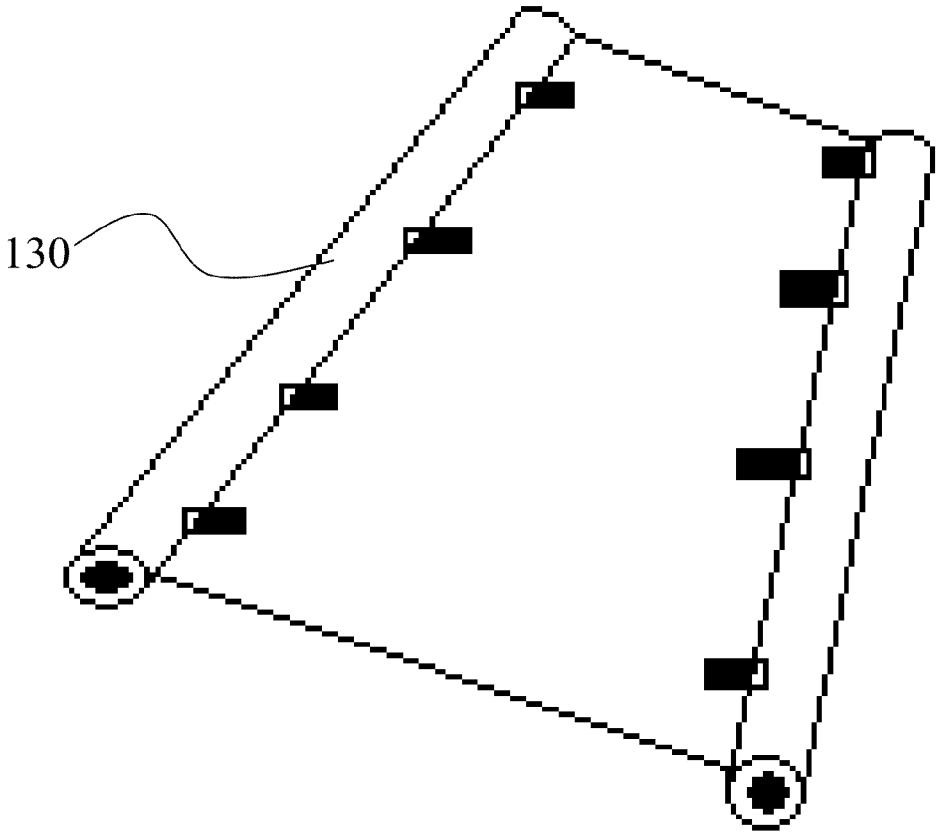
FIG. 5 is a back perspective view of an exemplary embodiment of the flexible target according to the present general inventive concept.
Figure 7:
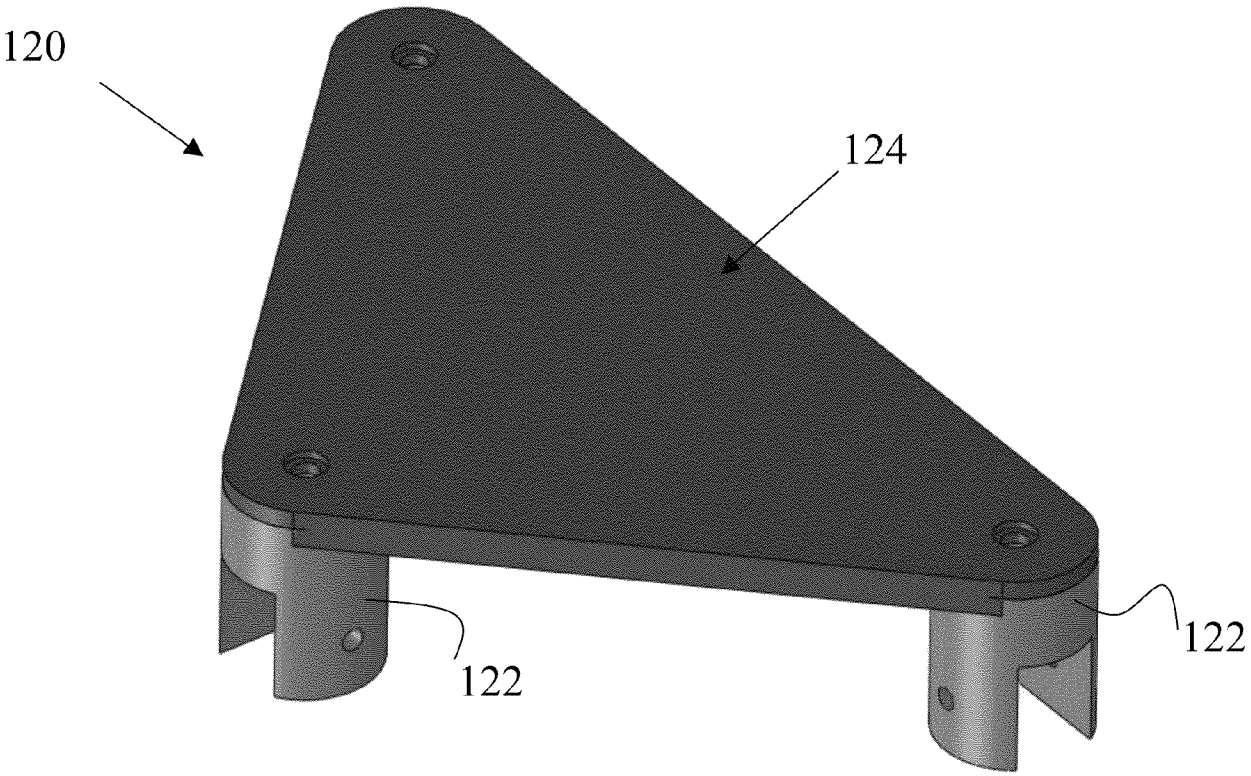
FIG. 7 is a top perspective view of a top hinge according to an exemplary embodiment of the present general inventive concept.
Figure 8:
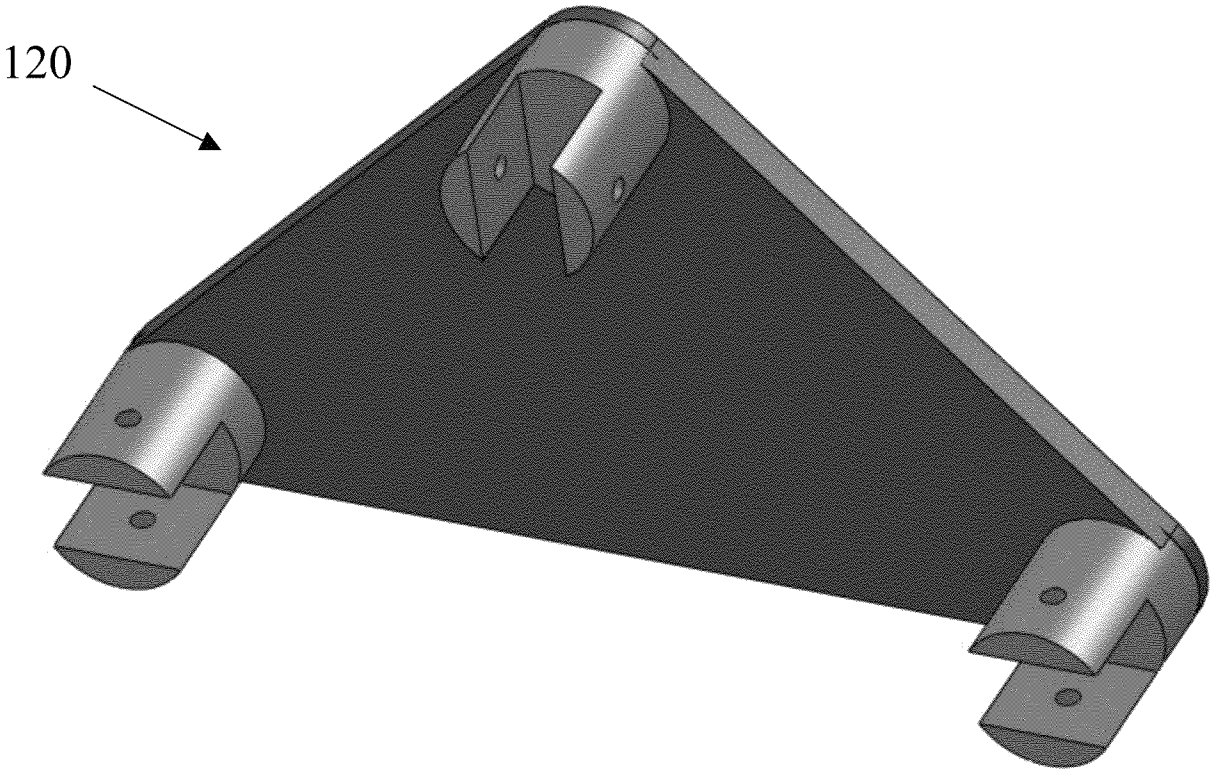
FIG. 8 is a bottom perspective view of the top hinge illustrated in FIG. 5.
Figure 9:
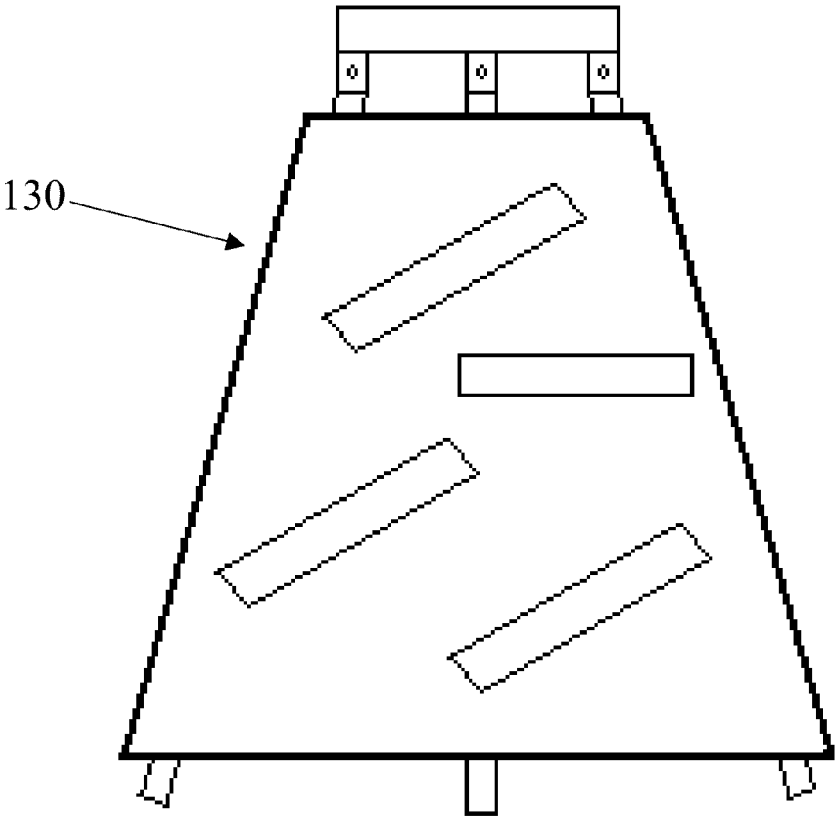
FIG. 9 is a front view of the flying disc target according to another exemplary embodiment of the present general inventive concept.

FIG. 4 is a front view of the flying disc target 100 according to another exemplary embodiment, with the flexible target 130 removed and FIG. 5 is a back perspective view of an exemplary embodiment of the flexible target 130 according to the present general inventive concept.

In exemplary embodiments, the plurality of segments and the locking member 116 are tubular in shape. The locking member 116 includes a larger external diameter to allow a user to easily grasp and rotate the locking member 116. A first end 116*a* of the locking member 116 has an inner diameter which corresponds to the external diameter of the first segment 112 and a second end 116*b* of the locking member 116 which has an inner diameter which corresponds to the external diameter of the second segment 114. That is, in exemplary embodiments, a user may rotate the locking member 116 in a clockwise direction to allow the second segment 114 to slide into the first segment 112 to thereby shorten an overall height of the flying disc target 100. The user may then rotate the locking member 116 in a counter-clockwise direction to lock the first and second segments 112, 114 in place. The locking member 116 may include various types of locking means to secure the first segment 112 with respect to the second segment 114.

In alternative exemplary embodiments, the first segment 112 may be coupled directly to the second segment 114 using an attachment means, such as screws or nuts and bolts. However, the present general inventive concept is not limited thereto. That is, in alternative exemplary embodiments, the plurality of adjustable legs 110 may include a flexible cord 113 which extends through a center of the first and second segments 112, 114 to allow the first and second segment to collapse when pulled apart, similar to the function of conventional tent frames.

Referring to FIGS. 1-2, in exemplary embodiments, the flexible target 130 includes a front side 130*a* and a back side 130*b*. The front side 130*a* and back side 130*b* may be formed in a substantially triangular shape. However, the present general inventive concept is not limited thereto. That is, the size and shape of the flexible target 130 may vary according to the size and shape of the top hinge 120 and the plurality of adjustable legs 110.

The flexible target 130 may be formed of a fabric, cloth, netting material, plastic sheeting, or various other flexible materials. In alternative exemplary embodiments, the flexible target 130 may be formed of plastic, metal, or wood. However, the present general inventive concept is not limited thereto.

As illustrated in FIG. 2, the flexible target 130 includes a plurality of disc storage compartments 138 coupled to the back side 130*b*. The flexible target 130 includes disc openings 136 through which flying discs may enter and which are caught in the disc storage compartments 138. In exemplary embodiments, users may throw flying discs through the disc openings 136 to test their skill level or for entertainment purposes. The plurality of disc storage compartments 138 may vary in size, location, and/or orientation in order to provide users with targets with varying levels of difficulty.

In exemplary embodiments, the back side 130*b* of the target may include a plurality of disc storage compartments 138 having a storage cavity 138*a* corresponding to the size, shape, and location of the plurality of disc openings 136. The storage cavity 138*a* is defined by a top pocket wall 138*b*, a bottom pocket wall 138*c*, and a back pocket wall 138*d*.

The flexible target 130 may further include loops 132 formed along opposing longitudinal sides 130*c*, 130*d* to be fitted onto the plurality of adjustable legs 110. That is, a first adjustable leg 110 may be inserted into loop 132 and an adjacent second adjustable leg 110 may be inserted into loop 134. Thus, as the first and second adjustable legs 110 are spread apart from each other, the flexible target 130 is kept taught. The loops 132, 134 may be formed using a removable attachment means such as Velcro, clips, buttons, or zippers. The loops 132, 134 may be opened and wrapped around the plurality of adjustable legs 110. However, the present general inventive concept is not limited thereto.

In exemplary embodiments, the loops 132, 134 may extend from a top side 130*e* to a bottom side 130*f* of the flexible target 130. However, in alternative embodiments, the loops 132, 134 may include a cut-out portion to accommodate a size and shape of the locking members 116.

In an exemplary embodiment, the flexible target 130 may be detachably coupled to at least two adjacent adjustable legs 110. That is, the flexible target 130 may include Velcro straps to secure a first side 130*a* of the flexible target 130 to a first adjustable leg 110 and a second side 130*b* of the flexible target 130 to an adjacent second adjustable leg 110.

In alternative exemplary embodiments, the flying disc target 100 may further include multiple flexible targets 130, such that all sides of the flying disc target 100 includes disc openings 136 through which flying discs may be thrown. That is, in alternative exemplary embodiments, each side of the tripod 140 formed by the plurality of adjustable legs 110 and the top hinge 120 may include a different flexible target 130, having disc openings 136 and disc storage compartments 138 located in different positions.

In alternative exemplary embodiments, the flexible target face 130 is easily removable via Velcro™ so that users may replace the target face 130 with various arrangements of targets corresponding to a particular skill level of the user. For instance, a first flexible target face 130 may include larger disc openings 136 and corresponding disc storage compartments 138 for less skilled users.

In exemplary embodiments, referring to FIG. 4, in exemplary embodiment, the tripod base 140 may further include leg locks 142 to lock the collapsible legs 110 in place. The locks 142 may collapse to allow the adjustable legs 110 to move with respect to each other.

In use, two flying disc targets 100 may be assembled in a tripod shape and adjusted to a particular height. The plurality of adjustable legs 110 may be expanded by unlocking the locking members 116 to adjust to a desired height. The flying disc targets 100 may be placed 10 to 30 feet apart from each other depending on the skill level of the users.

The user would then move a desired distance away from the flying disc target 100. Next, the user would test his/her skill in throwing a flying disc by aiming at the various target shapes or disc openings 136 on the flexible target face 130. The user would record points corresponding to the disc storage compartments 138, he/she successfully threw the disc into. A first user and a second user may determine which user goes first by flipping a coin or various other unbiased selection methods.

The first user throws a plurality of discs from a first disc target 100 toward the second disc target 100. Subsequently, the second user throws a plurality of discs from the second disc target 100 toward the first disc target 100. As illustrated in FIG. 1, users receives 1 point for throwing a disc into the bottom disc opening 136, 3 points for throwing a disc into the middle disc opening 136, and 5 points for throwing a disc into the topmost disc opening 136. However, the present general inventive concept is not limited thereto.

In an exemplary embodiment, a user throwing two consecutive discs in the opponents topmost disc opening 136 will receive a total of 12 points. The points earned by the first user may be cancelled if the second user throws a disc into the same disc opening of the opponent's flying disc targets 100. The winner is the user who reaches a score of 21 points and must have a score that is at least 2 points higher than the opponent's score. However, the present general inventive concept is not limited thereto.

In alternative exemplary embodiments, the users score may be recorded electronically as the discs pass through the disc openings 136. The score may then be sent wirelessly to the user's mobile device using a software application. The application would notify the user of his/her score, as well as the winner of the game.

That is, in alternative exemplary embodiments, the flying disc target 100 may further include an electronic sensor within each of the disc openings 136 such that an LED will be activated corresponding to the particular disc opening 136 through which a user throws a disc into. For instance, the flying disc target 100 would include three disc openings 136 on the flexible target 130. A first disc opening 136 on top, a second disc opening 136 in the middle, and a third disc opening 136 on the bottom. As a user throws a flying disc into the first disc opening 136, the electronic sensor would detect the flying disc and activate a first colored light. Thereby alerting the user which opening was hit by the flying disc. Similarly, as the user throws the flying disc into the second and third disc openings 136, the electronic sensor would detect the flying disc and activate a second and third colored light, respectively. In exemplary embodiments, the first colored light may be a red light, the second colored light may be a white light, and the third colored light may be a blue light. However, the present general inventive concept is not limited thereto. That is, the colors may correspond to a desired sporting team, school, or institution.

Figure 10:
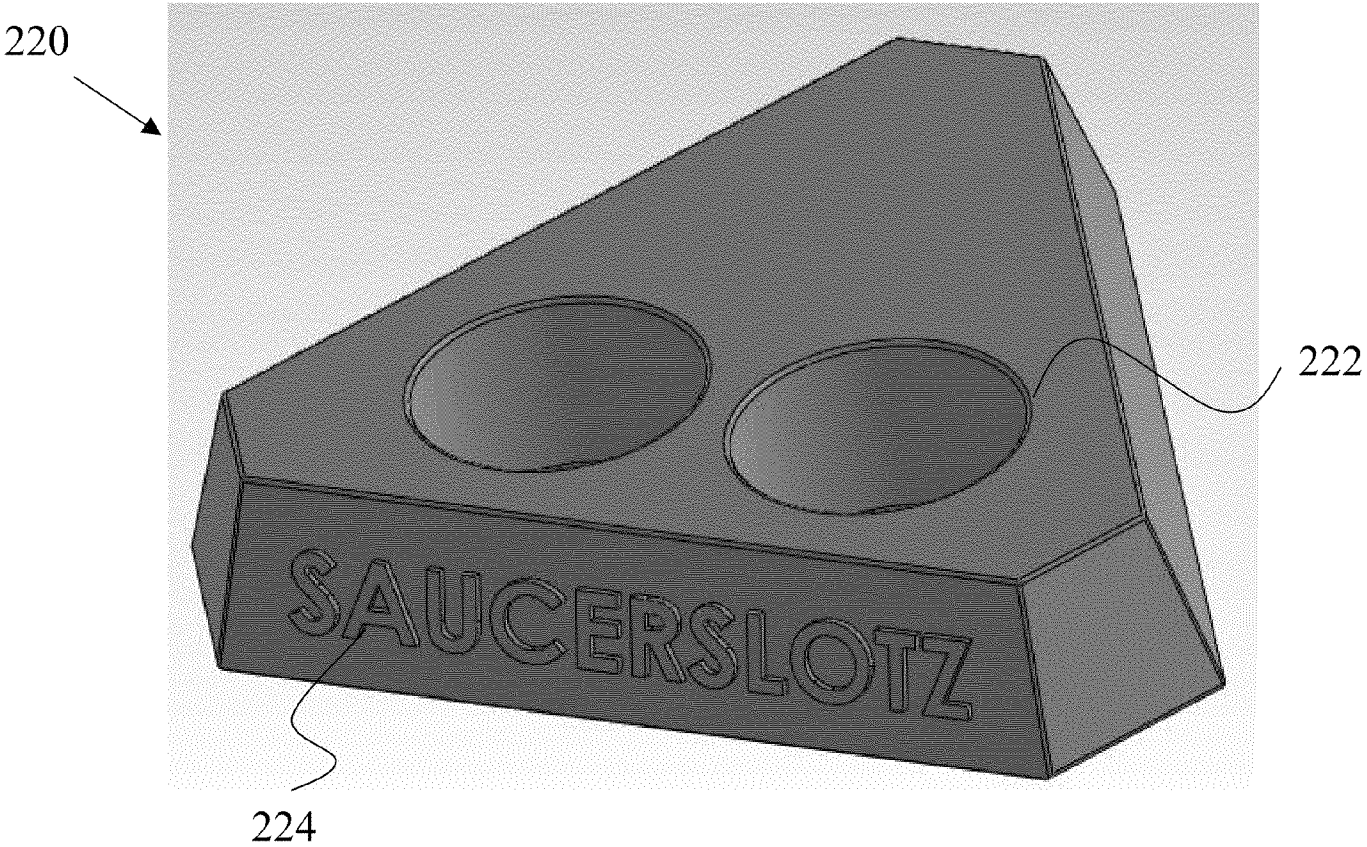
FIG. 10 is a front perspective view of a top hinge according to another exemplary embodiment of the present general inventive concept.
Figure 11:
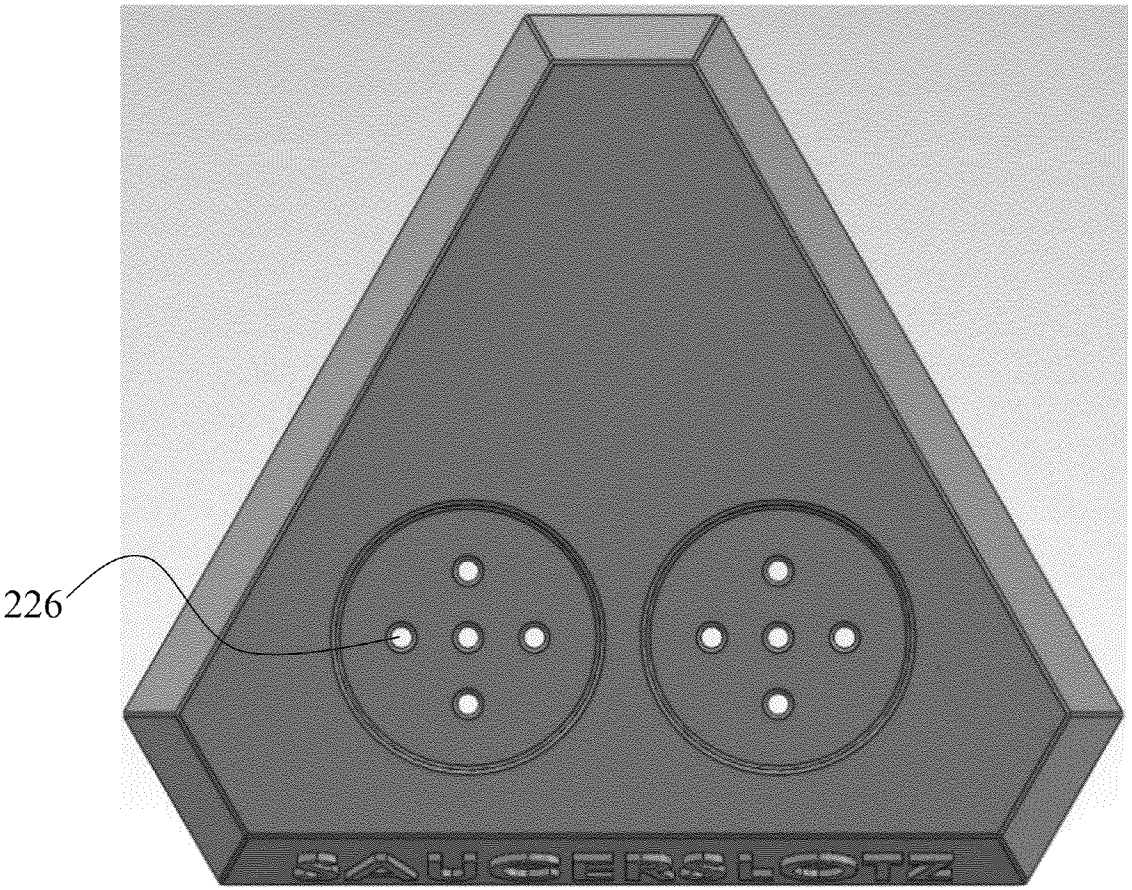
FIG. 11 is a top view of the top hinge illustrated in FIG. 10.
Figure 12:
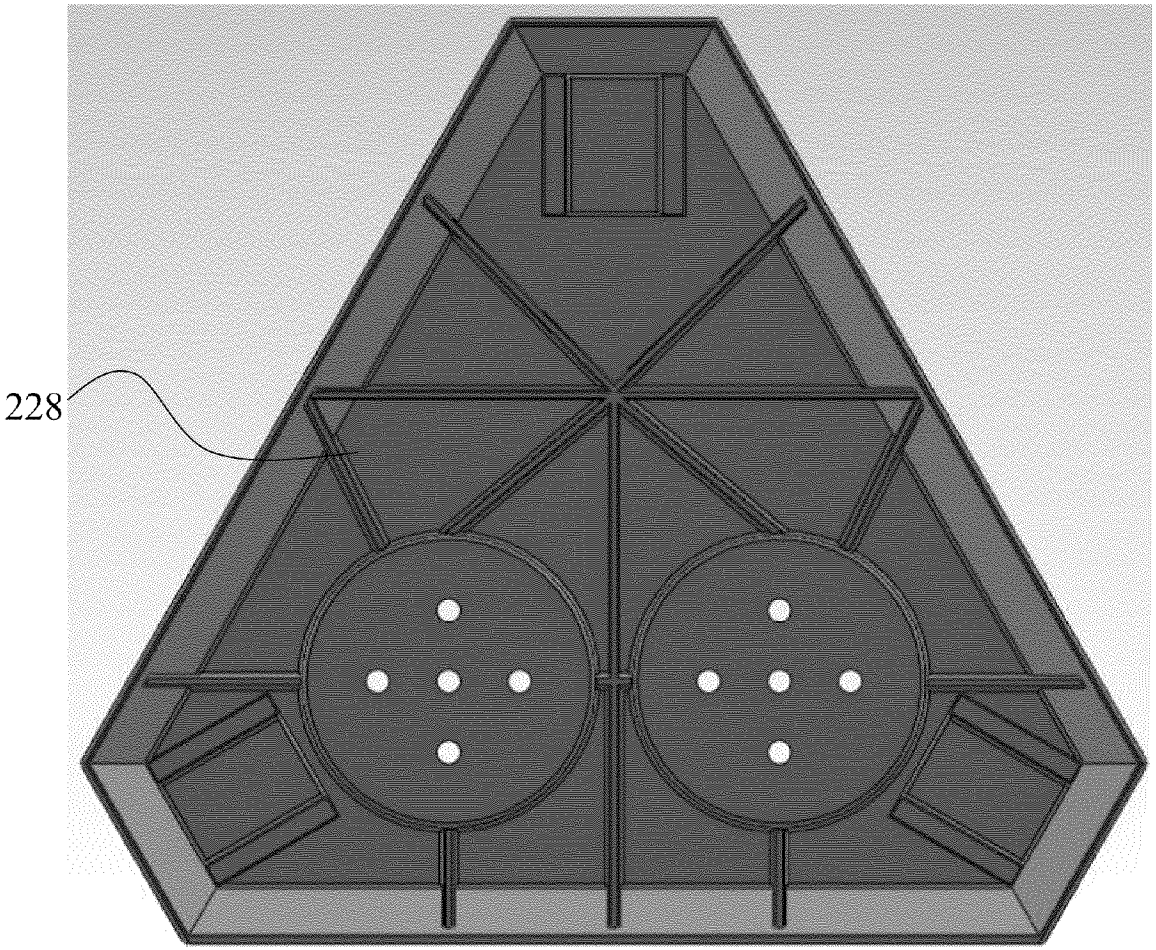
FIG. 12 is a bottom view of the top hinge illustrated in FIG. 10.

FIG. 10 is a front perspective view of a top hinge 220 according to another exemplary embodiment of the present general inventive concept. FIG. 11 is a top view of the top hinge 220 illustrated in FIG. 10 and FIG. 12 is a bottom view of the top hinge 220 illustrated in FIG. 10.

According to the present exemplary embodiment, the top hinge 220 includes a cup holder 222 and a faceplate 224. The faceplate 224 may indicate a sports team, a company name, or various other logos or advertising. In alternative exemplary embodiments, the faceplate 224 may be detachable from the top hinge 220.

The cup holder 222 may further include drainage holes 226 which allow liquids to drain from within the cup holder 222. That is, a user may place a beverage in the cup holder 222 during play which may spill into the cup holder 222, and then drain through the drainage holes 226. In alternative exemplary embodiments, the bottom surface of the top hinge 220 may include a power source storage compartment 228 to store a power source. The power source (not illustrated) may be a battery, solar panel, or adaptor which can be plugged into an AC or DC outlet.

It is to be understood that the foregoing illustrative exemplary embodiments have been provided merely for the purpose of explanation and are in no way to be construed as limiting of the present general inventive concept. Words used herein are words of description and illustration, rather than words of limitation. In addition, the advantages and objectives described herein may not be realized by each and every exemplary embodiment practicing the present general inventive concept. Further, although the present general inventive concept has been described herein with reference to particular structure, steps and/or exemplary embodiments, the present general inventive concept is not intended to be limited to the particulars disclosed herein. Rather, the present general inventive concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the present general inventive concept.

What is claimed is:

1. A flying disc target comprising a collapsible tripod frame, the frame including a plurality of expandable legs coupled to a triangular shaped top hinge, and a flexible target member detachably coupled to a first and second expandable leg of the plurality of expandable legs, the flexible target member having a front face and an opposing back face, the flexible target including a plurality of disc storage compartments having openings formed through the front face of the flexible target member, the plurality of disc storage compartments extending from the front face toward the back face, wherein the plurality of disc storage compartments having varying heights and widths.

2. The flying disc target of claim 1, wherein each disc storage compartment of the plurality of disc storage compartments has an associated score based on a height and a width of the disc storage compartment.

3. The flying disc target of claim 2, further comprising an electronic sensor which detects a disc entering each of the plurality of disc storage compartments and transmits a signal representing the score earned corresponding to the particular disc storage compartment in which the flying disc is detected to an external device.

4. The flying disc target of claim 2, wherein the external device includes a mobile device having an application to display and record a total score for multiple users.

* * * * *